United States Patent [19]

Aertker et al.

[11] Patent Number: 4,565,529

[45] Date of Patent: Jan. 21, 1986

[54] REMOTELY CONTROLLED STEERING APPARATUS FOR OUTBOARD TROLLING MOTORS

[76] Inventors: Walter P. Aertker, 2741 Hill St.; William L. Taylor, 3403 Coldstream Ave.; Frank Medica, 1007 Candy La., all of Alexandria, La. 71301

[21] Appl. No.: 523,940

[22] Filed: Aug. 17, 1983

[51] Int. Cl.[4] ..... B63H 21/26

[52] U.S. Cl. ..... 440/7; 114/144 E; 114/153

[58] Field of Search ..... 440/6, 7, 62; 114/144 A, 144 E, 153; 446/154

[56] References Cited

U.S. PATENT DOCUMENTS

| | | | |
|---|---|---|---|
| 2,804,838 | 9/1957 | Moser | 440/7 |
| 2,877,733 | 3/1959 | Harris | 440/7 |
| 2,951,460 | 9/1960 | Pierson | 440/62 X |
| 3,602,181 | 8/1971 | Harris | 114/153 |
| 3,689,927 | 9/1972 | Boston | 114/144 A |
| 3,807,345 | 4/1974 | Peterson | 114/153 |
| 3,889,625 | 6/1975 | Roller et al. | 114/153 |
| 4,008,500 | 2/1977 | Hall, Jr. | 297/349 |
| 4,143,436 | 3/1979 | Jones | 114/153 |

*Primary Examiner*—Sherman D. Basinger

*Attorney, Agent, or Firm*—Pravel, Gambrell, Hewitt & Kimball

[57] ABSTRACT

A control mechanism for a boat having a seat assembly to support a pilot provides an outboard motor which is directionally controlled by extension and retraction of a control cable with the control mechanism having a pedal which is generally planar on its upper surface receptive of the pilot's foot. A bracket mounts the pedal at a location below the seat assembly so that the user occupying the seat can position one of his feet on the pedal. A pair of switch surfaces are disposed on opposite sides of the pedal, each surface extending above the pedal surface so that lateral movement of the user's foot when positioned on the pedal can contact one of the switch surfaces. A switch associated with each switch surface can then be activated for directionally moving the outboard motor into different positions responsive to pressure applied to one or other of the switch surfaces applied by the edge of the user's foot. In one embodiment, the pedal and motor are remotely placed with respect to one another, and the pedal "communicates" with the trolling motor using radio waves. In that embodiment, a transmitter is carried by the foot pedal or similar pilot-operated control, and a receiver positioned near the motor activates a reversible motor to steer the trolling motor, preferably by cable extension/-retraction.

15 Claims, 8 Drawing Figures

REMOTELY CONTROLLED STEERING APPARATUS FOR OUTBOARD TROLLING MOTORS

BACKGROUND OF THE INVENTION

1. Technical Field

The present invention relates to steering mechanisms for trolling and like outboard motors and more particularly relates to an improved steering apparatus for trolling and outboard motors of the type which are directionally controlled by movement of a boat pilot's foot.

2. General Background

Numerous outboard motors are used by sportsmen on either the bow or stern of their boat or vessel. These outboard motors generally are of two classes. The first class involves internal combustion engine type outboard motors. These can be hand steered using a tiller which affixes directly to the head portion of the motor or a system of usually steel or aluminum metallic cable is rigged to the hull of the vessel and to a steering wheel so that when the operator or pilot of the boat steers the wheel in the desired direction, the power head of the boat is rotated and with it rotates the drive shaft and propeller. The effect is very similar to the driving of an automobile in that rotation of the wheel is a left handed or counter-clockwise direction effects a left turn of the boat and likewise, a right hand or clockwise rotation of wheel effects a right hand turn of the boat.

A second class of outboard type motors are referred to generally as trolling motors. Trolling motors are usually smaller, electrically operated devices. Trolling motors are electrical inter alia because they are quiet and do not disturb fish. Trolling motors are used primarily by fishing for bass fishing, for example, as they allow the fishermen to move in and out of shallow waters which are often congested with tree stumps, overhanging vines, water hyacinths, water lillies, and floating logs. It is these congested areas which often are the most desirable for the fish and for the fisherman. The use of electrical type trolling motors is known in the art and numerous models are commercially available. A trolling motor has basically three parts, a lowermost motor housing provides a propeller shaft and a propeller. An elongated vertical shaft supports the motor housing and is usually attached at its top portion to a transom mount which affixes to the transom of a vessel. The third portion of the vessel is an upper most head which provides electrical connections and sometimes is provided with a tiller attached directly to it so that it can be hand steered. A typical outboard electrical trolling motor having a handle for steering can be seen, for example, in U.S. Pat. No. 2,804,838 issued to H. W. Moser.

Many trolling motors are commercially available which are steered by mean of a dual cable arrangement in which an outer cable in clamped in a stationary position and an inner cable is moved by an operator so that it remotely moves the motor. The problem with cable operated trolling motors is that it requires continuous pivotal movement in a fore/aft fashion of the user's foot in order to effect a left to right movement of the vessel. This is an unnatural movement for the foot and it is uncomfortable over a very long period of time such as over several hours of fishing where a good deal of turning is required. Such cable operated steering mechanisms also require that the foot of the operator be turned to a greater and greater degree in order to effect a corresponding greater turn of the motor. For example, if the foot pedal were at a forty-five degree angle with respect to the hull of the boat in a neutral position in which the trolling motor were aligned with the longitudinal axis of the vessel, the vessel would proceed forward in a straight line without turning. In order to make a gradual turn, the user might depress the foot pedal to an angle of thirty degrees which might move the boat slightly to one side. However, to effect a greater turning, the user would have to then depress the pedal further to, for example, a ten degree angle with respect to the hull. This pivotal movement of the foot forward and backward as aforedescribed requires energy to be expended directly in a mechanical fashion from the foot of the user to the motor itself. If the cables are not properly lubricated, an even greater degree of fatigue will be experienced by the boat operator.

Various steering control mechanisms have been patented in an attempt to solve the problem of steering trolling outboard type motors. Many of these patented devices have used foot pedals or foot controls so that the hands of the operator are free to operate a fishing rod and reel. Many of these devices are used in combination with a chair which can swivel so that the user can move freely in a rotational fashion with respect to the hull of the boat fishing off both sides and off the front of the boat, for example.

U.S. Pat. No. 4,143,436 issued to Ray Jones entitled "Directional Control Mechanism for a Trolling Motor" shows a pedal operated control mechanism for controlling the direction of travel of a fishing boat. In order to remain at a location convenient to the fisherman, the pedal is mounted on a bracket arm which rotates with the boat seat. The pedal has a control wire which enters a stationary control housing and which raises and lowers a pair of lever arms as the wire extends and retracts. The foot pedal requires fore/aft pivotal movement to steer the boat.

U.S. Pat. No. 4,008,500 issued to Hall, Jr. entitled "Fishing Boat Platform" discloses a rotatable platform provided to support the chair of a bass fishing boat. The platform has the chair rotatably mounted at one end and includes a boat rest for positioning the feet of the fisherman at the other. The feet positioning end preferably includes a wedge-shaped footrest for one foot of the fisherman, adjacent to which is mounted a foot actuated control pedal and the pedal controls electric trolling motor. A number of push button control switches on a foot pedal activate the propulsion.

U.S. Pat. No. 3,807,345 entitled "Trolling Motor Steering and Speed Control Means" issued to Peterson shows a foot-operated mechanism for controlling both the speed and steering of a trolling motor which may be operated by one foot and conserves the available stored electrical power of a fishing boat. A pivotal foot lever is connected with the trolling motor in such a manner that the steering of the motor is accomplished by a rocking or pivotal action of the lever by a pivot action of the ankle of the operator, and the speed of the trolling motor is controlled by a substantially horizontal sliding motion of the foot which is pivoted from the knee of the operator, thus permitting control of the steering and speed of the motor by non-conflicting motions of the foot whereby the speed and steering may be controlled either simultaneously or independently.

U.S. Pat. No. 3,889,625 entitled "Control Cable Connection for an Electric Trolling Motor" issued to Roller et al discloses a connection for securing the control cable of a remotely controlled electric trolling motor to the drive wheel of the remote control unit. A connection post is pivotally mounted offset from the pivot axis of the wheel and is equipped with a radial slot and an axial bore for receiving the L-shaped end of the control cable. A pin transacting the radial slot above the cable securely retains the cable end in the slot and bore.

U.S. Pat. No. 3,602,181 entitled "Outboard Motor Steering Control" and issued to G. H. Harris discloses an outboard motor including a hollow casing assembly for mounted on a boat. An upstanding tubular shaft is rotatably mounted in the casing assembly. A hollow pinion is mounted on the shaft and a rack meshes with the pinion. The rack is coupled to a steering control pedal and is mounted for movement in the casing transversely of the shaft. An electric motor is mounted on a lower end of the shaft, and a propeller is driven by the motor and directed transversely of the shaft.

U.S. Pat. No. 2,877,733 entitled "Electric Steering and Power Control System for Outboard Motors" issued to G. H. Harris is an earlier patent of the above-referenced patentee relating to devices for steering and powering boats and more particularly relating to an electrical system for conveniently controlling the direction of travel of the boat.

U.S. Pat. No. 2,804,838 issues to H. W. Moser and entitled "Trolling Outboard Motor Control" includes an attachment formed of a series of semi-cylindrical parts adapted to be applied over the steering column of an electrically operated outboard boat motor and including a split sleeve adapted to surround the column with such split sleeve having serrations at its upper end. The split sleeve has a worm gear fixed thereto and is adapted to be received in suitable bearings formed in a split housing which may rotate relative to such split sleeve with an electrical steering motor driving a worm which cooperates with the worm gear on the rotatable sleeve.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein.

DETAILED DESCRIPTIOON OF THE PREFERRED EMBODIMENT

FIGS. 1 through 5 show generally the preferred embodiment of the apparatus of the present invention designated generally by the numeral 10.

Figure 1:
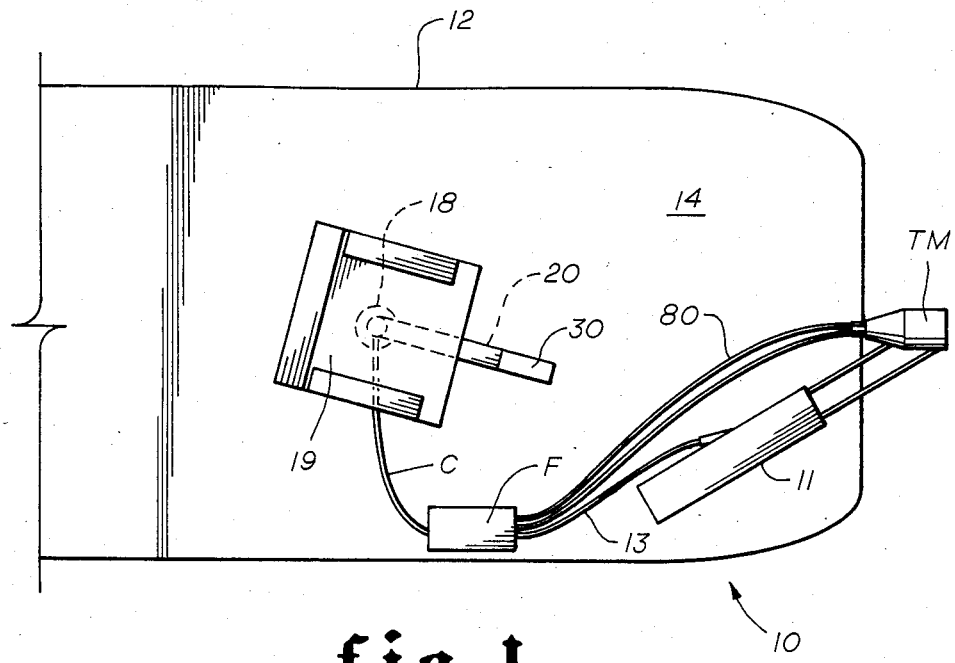
FIG. 1 is a top schematic view of the preferred embodiment of the apparatus of the present invention.
Figure 2:
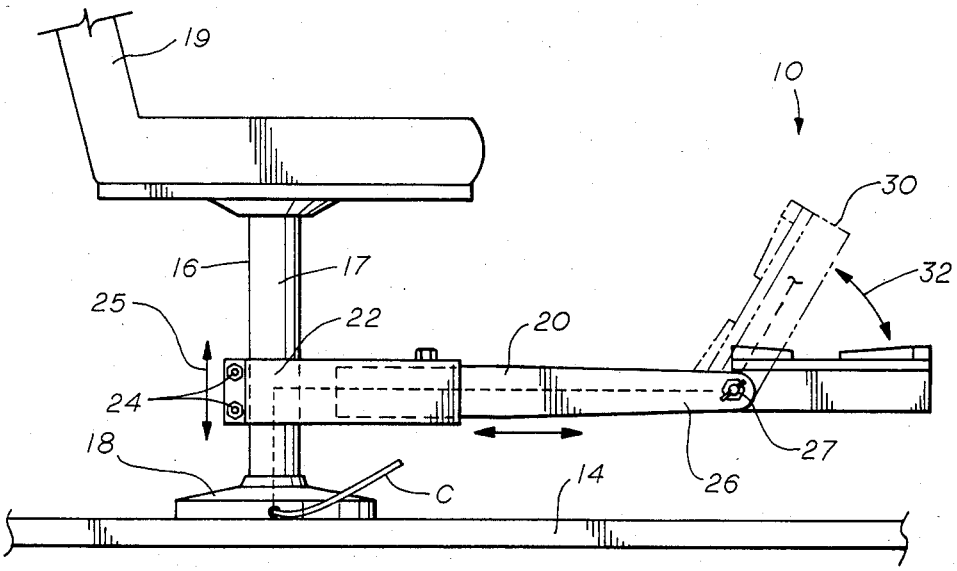
FIG. 2 is a side schematic of the preferred embodiment of the apparatus of the present invention.

In FIGS. 1 and 2 there can be seen a boat 12 having a deck 14 upon which is supported a pedestal chair 16 having a pedestal portion 17 bolted, for example, to deck 14 at base 18. An outboard motor such as an electric trolling motor TM is supported off one end of the hull 12 by means of, for example, a track type folding mount 11. Electric cable 13 provides power to propell boat 12. Cable 80 steers trolling motor TM. The opposite end portion of pedestal 17 supports a chair 19 which would normally be occupied by a pilot or user (not shown). Depending horizontally from pedestal 17 can be seen control arm 20 which attaches at one end portion 22 to pedestal 17 by means of, for example, a bolted connection 24. Arm 20 would preferably be movable in a vertical direction as illustrated by the arrow 25 in FIG. 2. This could be accomplished, for example, by loosening the bolted connection 24 and raising or lowering arm 20 as desired so that the horizontal elevational level of arm 20 would be appropriate for the particular user or pilot operating the apparatus 10. At the opposite end portion 26 of arm 20 there can be seen a foot pedal 30 which is pivotally attached at 27 by means of a shaft and bolt connection 27, for example, to arm 20. Arrow 32 in FIG. 2 schematically illustrates the pivotal connection 27 between foot pedal 30 and arm 20. This allows foot pedal 20 to be angularly adjusted to conform to a position comfortable to the pilot or user. Connection 27 could then be tightened to secure pedal 30 in the desired position. Cable C electrically couples pedal 30 to motor mount frame F.

Figure 3:
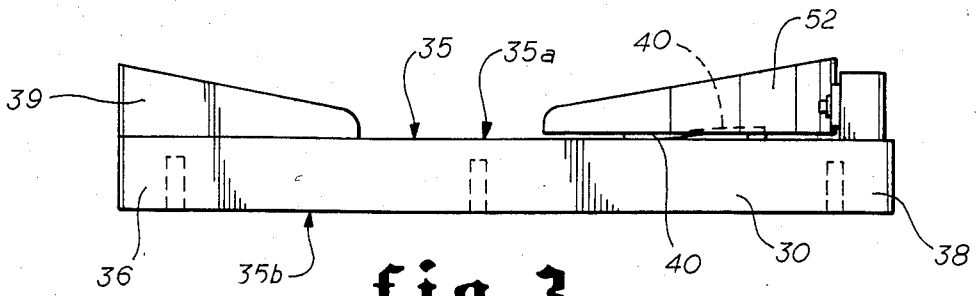
FIG. 3 is a side view of the foot bracket portion of the preferred embodiment of the apparatus of the present invention.
Figure 4:
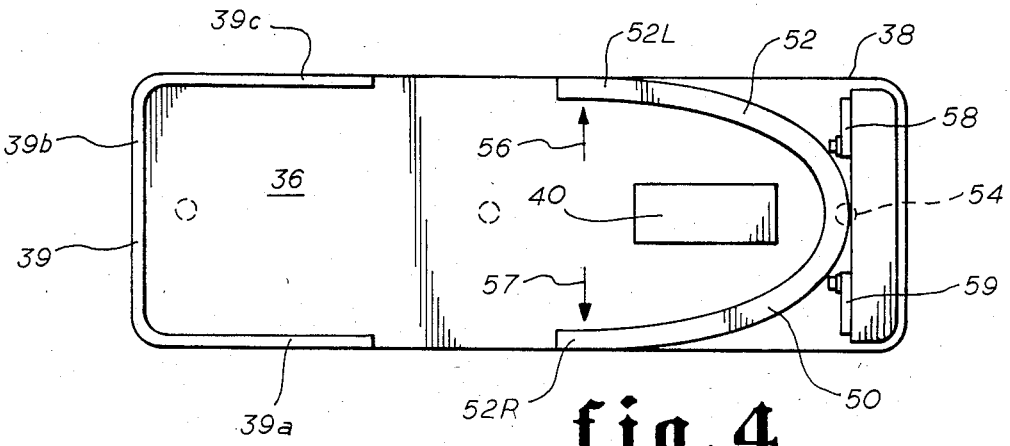
FIG. 4 is a top view of the preferred embodiment of the apparatus of the present invention illustrating the foot pedal portion thereof.

FIGS. 3 and 4 illustrate pedal 30 more particularly. Pedal 30 provides an upper surface **35*a* which normally is occupied by the foot of the pilot or user, and a lower surface 35*b* as well as a peripheral sidewall 35*c*. An interior could be hollow, but watertight so that the interior could contain the electrical components of FIG. 8. The end portions of pedal 30 provide a heel portion 36 and a toe portion 38. Heel portion 36 has a generally U-shaped fixed vertical shoulder 39 for holding the heel of a pilot in its proper position upon surface 35 and more particularly upon the heel portion 36 of pedal 30. The top view in FIG. 4 shows that shoulder 39 provides three parts including 39**A–C.

The opposite end portion of pedal 30 provides toe portion 38 which includes accelerator 40 and steering switch assembly 50. Accelerator 40 would be, for example, an electrical switch such as a potentiometer which would increase current flow to the main propulsion motor of a trolling motor depending on the degree to which it were compressed. The effect would be analogous to the depression of an automobile accelerator and the corresponding increased acceleration of the car.

Steering switch assembly 50 includes a generally U-shaped toe-actuated tiller 52. Tiller 52 is mounted pivotally upon shaft 54 to the toe 38 portion of pedal 30. When pressure is applied by the toe of a pilot or user to the left 52L side of tiller 52 (see arrow 56, FIG. 4), this causes tiller 52 to depress left steering switch 58.

Figure 5:
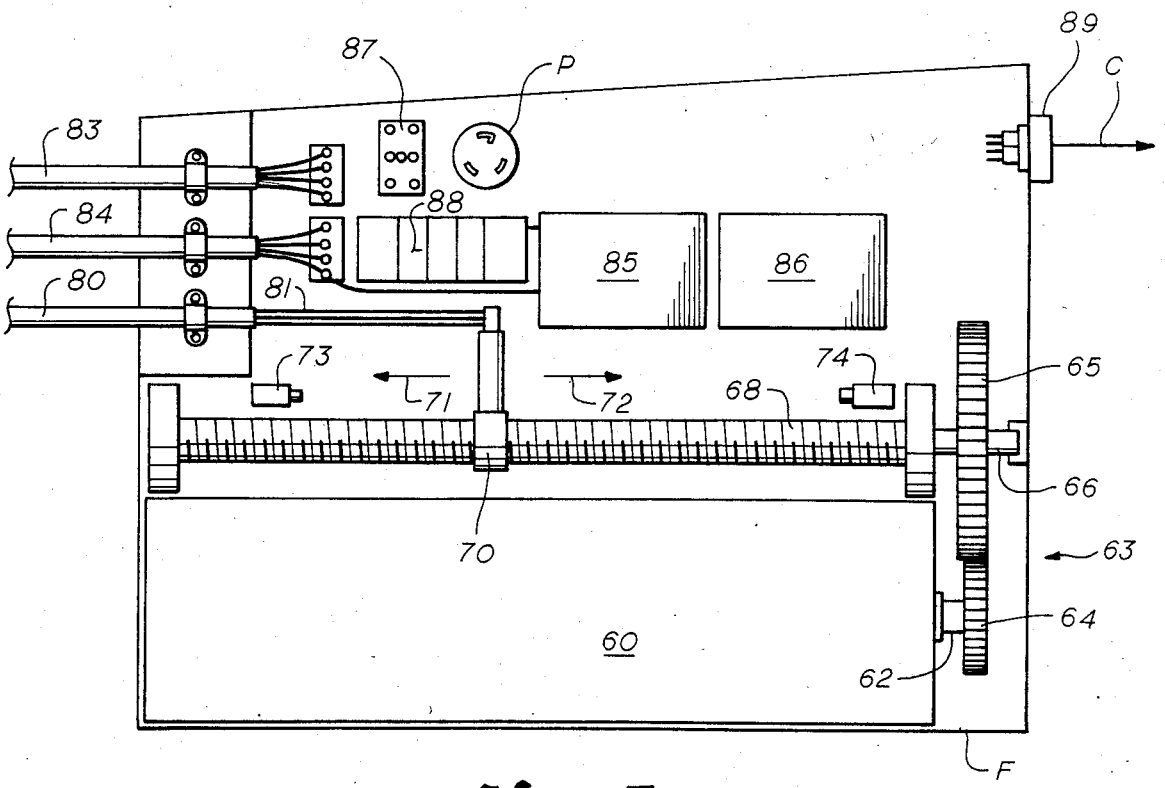
FIG. 5 is top schematic of the preferred embodiment of the apparatus of the present invention illustrating the cable drive portion thereof.

In like manner, when tiller 52 is pivoted to the right as illustrated by the arrow 57 in FIG. 4, switch 59 is depressed. Switches 58, 59 respectively actuate left and right rotation of a reversible motor 60 which is shown in FIG. 5. Motor 60 has a drive shaft 62 which can be attached, for example, to a gear reduction system designated generally by the numeral 63 in FIG. 5. More specifically, a pair of gears 64, 65 can be seen with gears 64 being attached to drive shaft 62 of motor 60 and gear 65 being attached to shaft 66 which provides a threaded portion 68. The threaded portion 68 engages cable drive bracket 70 which is threadably attached thereto. One skilled in the art will notice that opposite directional rotations of shaft 66, will cause opposite directional linear movement of bracket 70 as shown by the arrows 71, 72 in FIG. 5. Limit switches 73, 74 could be provided at the ends of shaft 66 so that when bracket 70 reached either end portion of shaft 66, the circuit would be interrupted, de-energizing motor 60. Cable C electrically interfaces pedal 30 and motor mount frame F at plug 89.

Bracket 70 attaches to the internal moving cable 81 of the main steering cable 80 of trolling motor TM so that extension or retraction alternatively of the internal cable 81 produces desirably a left or right rotation of the trolling motor TM itself. From the above it can be seen that when the left hand turn switch 58 is actuated by pressing the left hand portion 52L of tiller 52 (see arrow 56 of FIG. 4), a corresponding left hand turn can be effected in the trolling motor and in boat. Similarly, by pressing the right 52R portion of the tiller 52 and actuating switch 59, a right hand turn can be effected in the trolling motor and in the boat. This is accomplished by the user performing a very natural left to right movement of his foot over a very short distance, only that constant fixed distance that is necessary to actuate the switch. Once the selected switch is activated, rotation of the outboard motor continues, gradually increasing the angle of deflection between the boat and the propeller thus increasing the radius of the turn by the boat itself. Once the switch is actuated, the outboard motor will continue to rotate further and further in the desired direction until the user lifts his foot off the switch by returning the tiller 52 to a neutral center position.

Figure 6:
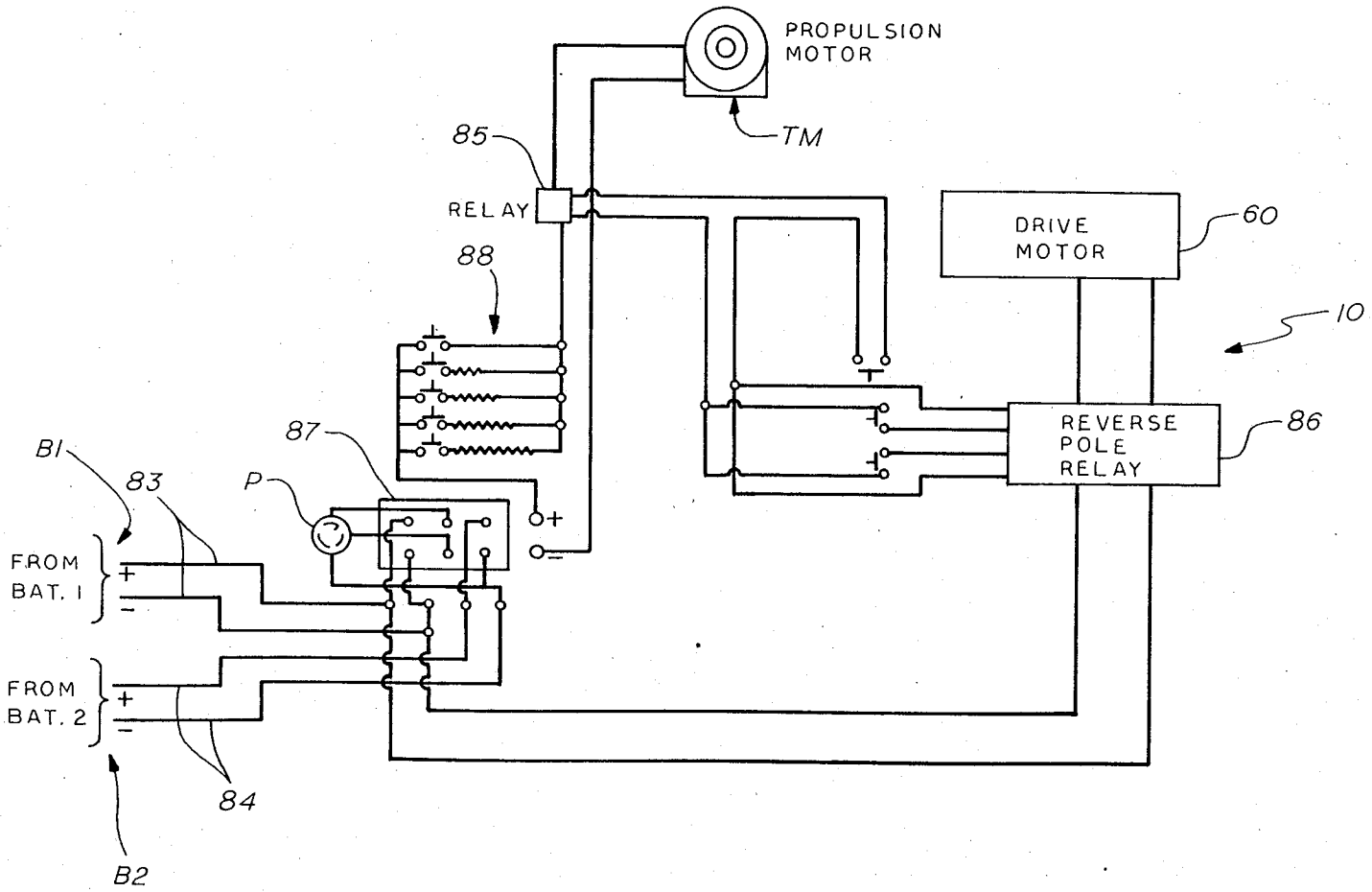
FIG. 6 is an electrical schematic diagram of the preferred embodiment of the apparatus of the present invention.

FIG. 6 shows an electrical schematic diagram of the circuit portion of the preferred embodiment of the apparatus of the present invention designated by the numeral 10. Drive motor 60 can be seen as connected to a reverse pole relay 86 which is attached to a power source p. One or more batteries B1, B2 provide energy through lines 83, 84 for the circuit. A plug P can be placed as shown in the circuit for the purposes of recharging the battery if desired. Reverse poll relay switch 86 reverses polarity of reversible drive motor 60. Potentiometer 88 regulates motor TM propulsion. Double poll double throw switch 87 allows either twelve volt (12 v) or twenty-four volt (24 v) current to be selected. The trolling motor itself is designated generally by the letters TM in FIG. 6 of the drawing.

Figure 7:
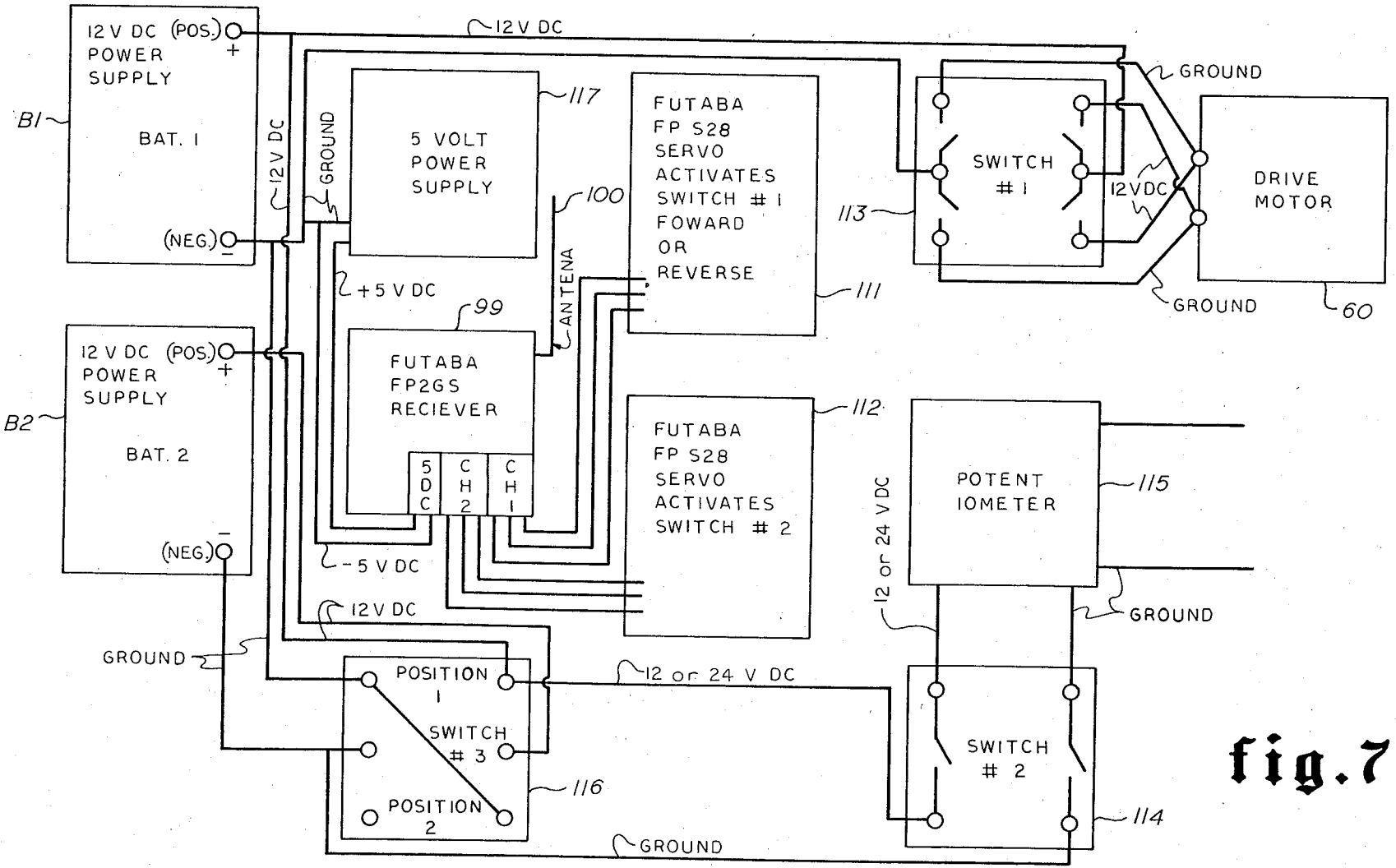
FIG. 7 is an electrical schematic diagram of an alternate embodiment of the apparatus of the present invention.
Figure 8:
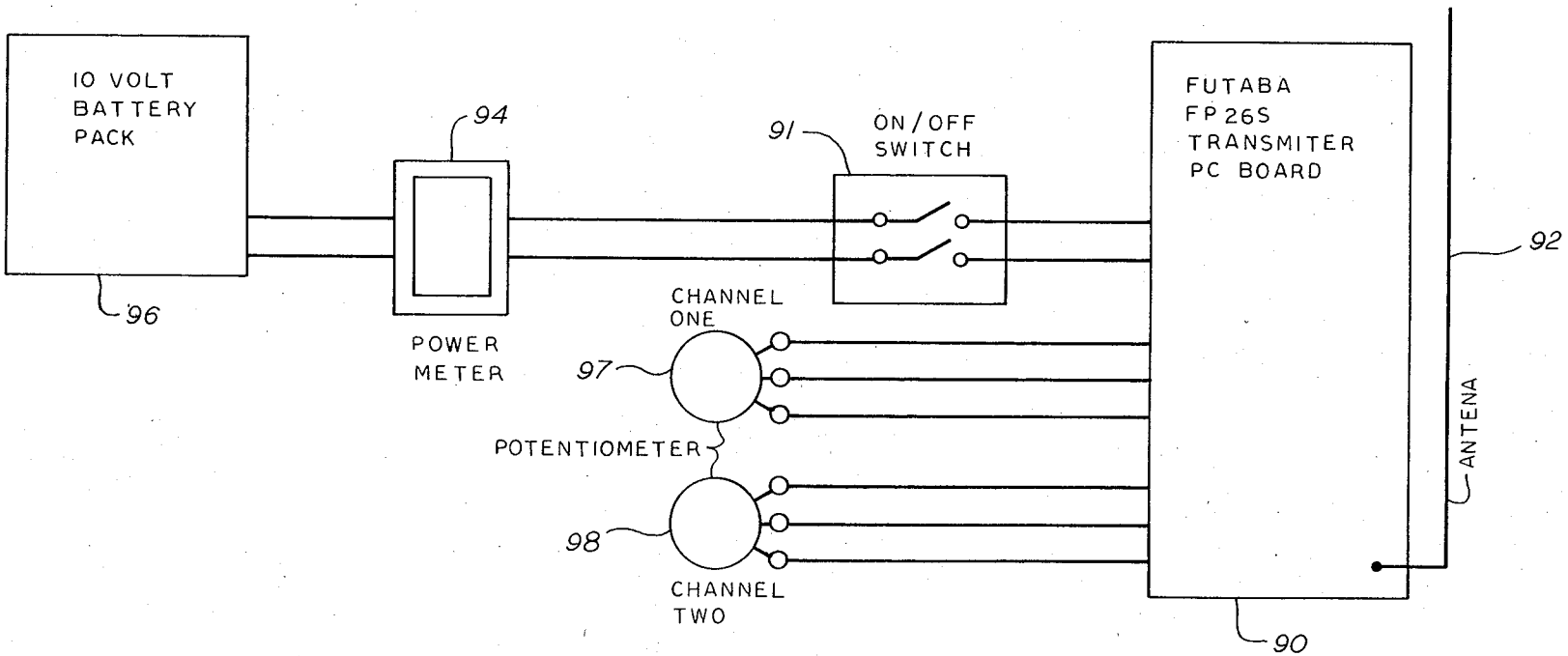
FIG. 8 is another alternate embodiment of the apparatus of the present invention illustrating the electrical schematic diagram portion thereof.

The embodiment of FIGS. 7 and 8 is an alternate remote control embodiment. FIG. 8 shows the schematic diagram for the foot piece 30 including a transmitter PC board 90, an on-off switch 91, a power meter 94, and a battery pack energy source 96. A first potentiometer 97 is connected to tiller 52 so that left and right movements of tiller 52, as aforedescribed, effect the left and right turning of the trolling motor TM. An antenna 92 connects to the transmitter board 90 for the purposes of transmitting radio wave signals to the receiver 99 having antenna 100 (see FIG. 7). The components of FIG. 8 could be housed in foot pedal 30 interior. For example, foot pedal 30 could be metallic or plastic, having a hollow interior to house the components of FIG. 8. Such a hollowed foot pedal housing shaped shown in FIGS. 3–4 would preferably be watertight to prevent water contact with the components of FIG. 8 that would be housed therein.

The receiver 99 of FIG. 7 activates either left or right servos 111, 112. Each servo 111, 112 respectively activates a switch 113, 114. The switch 113 is a reversible microswitch such as "Robbe" Bestell-NR-8094 reversible microswitch. Switch 113 operates reversible motor 60. Switch 114 operates potentiometer 115 to regulate propulsion of a trolling motor TM. Switch 116 is a three-position switch that can feed either "high," "medium," or "low" current flow to potentiometer 115. A battery power supply 117 operates the micro components of FIG. 7 including receiver 99, and servos 111, 112. Receiver 99 can be a Futaba FPG25 receiver. Servos 111, 112 can be Futaba FPS28 servos. Transmitter 90 can be a Futaba FP26S transmitter PC board. With the embodiment of FIGS. 7–8, no cables or wires connect between pedal 30 and motor mount frame F. Rather, radio waves emitted by transmitter 90, preferably housed within foot pedal 30 are received by receiver 99. Thus, foot pedal 30 could be moved anywhere on boat 12 and still operate trolling motor TM. Indeed, more than one foot pedal 30 could be provided so that more than one person could operate trolling motor TM. Thus, two fishermen, sitting in two separate chairs 19 in boat 12 could alternate control of motor TM without ever moving from his or her respective chair. On/off switches 91 could be provided on each foot pedal to de-energize one fisherman's foot pedal and transmitter while another operated the trolling motor TM. By using a reversible drive motor 60 activated by the receiver and servos 111, 112 as shown in FIG. 7, a sufficient force can be developed using motor 60 to extend and retract cable 81 and thus steer motor TM.

Because many varying and different embodiments may be made within the scope of the inventive concept herein taught, and because many modifications may be made in the embodiments herein detailed in accordance with the descriptive requirements of the law, it is to be understood that the details are to be interpreted as illustrative and not in a limited sense.

What is claimed as invention is:

1. A control mechanism for a boat having a seat assembly to support a pilot and an outboard motor which is directionally controlled by extension and retraction of a control cable, said control mechanism comprising:

a. a pedal having a generally planar upper surface;

b. means for mounting the pedal at a location below the seat assembly so that the pilot occupying the seat can position one of his feet on the pedal and use the foot to operate the outboard motor;

c. a pair of switch surfaces disposed on opposite sides of the pedal, each surface extending above the pedal surface so that lateral movement of the user's foot, when positioned on the pedal, contacts one of the switch surfaces;

d. switch means associated with each switch surface for directionally moving the outboard motor to different positions responsive to pressure applied to one of the switch surfaces by one side edge of the user's foot; and e. a generally U-shaped tiller having one open-ended portion and a pair of spaced apart side wall surfaces with the switch surfaces being the inside surfaces of the side walls, the tiller affixed to the top of the pedal and the open portion receiving the pilot's foot during use.

2. The boat control mechanism of claim 1, wherein the tiller is pivotally affixed to the pedal so that pivotal movement of the tiller activates the switch means.

3. The boat control mechanism of claim 1 further comprising electrically actuated motor drive means for extending/retracting the cable responsive to lateral movement of the pilot's foot in respective lateral directions.

4. The boat control mechanism of claim 3 wherein the motor drive means comprises:

a. a housing;

b. a motor affixed to the housing;

c. a bracket affixed to the control cable; and d. a gear mechanism interconnecting the motor and the cable bracket so that the motor extends/retracts the cable.

5. The boat control mechanism of claim 1, wherein the switch means comprises in part a pair of electrical switches activated by the switch surfaces and further comprising electric motor drive means for extending/retracting the control cable responsive to activation of the switches.

6. The boat control mechanism of claim 1, wherein the switch means includes two switches mounted laterally on opposite sides of the pedal and raised above the pedal surface so that lateral foot movement can operate the switches.

7. The boat control mechanism of claim 1, wherein the switch means comprises in part means for sending an airwave signal which indicates a preselected position of the pilot's foot on the foot pedal, and remotely controlled receiver means for directionally steering the outboard motor.

8. A remotely controlled steering apparatus for a boat having an outboard trolling motor that is to be directionally steered in directions selected by the pilot, comprising:

a. wireless airwave transmitting means positioned by the pilot for generating an airwave type signal which indicates a directional steering position that is pre-selected by the pilot such as "right" or "left;"

b. a motor drive positioned adjacent the outboard trolling motor for powering movement of the outboard motor with respect to the boat between "left" and "right" steering positions;

c. linkage means connecting the motor drive and outboard trolling motor for steering the outboard trolling motor responsive to activation of the motor drive;

d. switch means for activating/deactivating the motor drive so that the switch means can turn the motor drive on when the outboard trolling motor is to be steered, and off when the desired steering is completed; and e. receiver means operable by the generated airwave signal and remotely placed from the wireless airwave transmitting means, for moving the switch means between on and off switch positions that respectively activate and deactivate the motor drive.

9. The boat control mechanism of claim 8 further comprising throttle means operable by the pilot for generating an airwave signal which indicates a thrust value selected by the pilot such as "high" or "low" and the receiver means can also regulate thrust of the outboard trolling motor.

10. The boat control mechanism of claim 9, wherein the throttle means includes an accelerator on the pedal means which can be operated by the foot of the pilot.

11. The boat control mechanism of claim 9 wherein there is further provided pedal means providing an upper surface receptive of the foot of a pilot.

12. The boat control mechanism of claim 8, wherein the outboard trolling motor is directionally controlled by extension and retraction of a control cable, and the motor drive moves the outboard trolling motor into steering positions by extending/retracting the control cable responsive to selection by the pilot of a directional steering position.

13. The boat control mechanism of claim 12, wherein the motor drive comprises:

a frame;

a reversible motor attached to the frame;

means for supplying energy to the motor so that it will operate;

threaded shaft rotatably supported on the frame;

cable support bracket means threadably mounted on the threaded shaft and attached to the cable so that rotation of the shaft in opposite directions respectively extends/retracts the control cable.

14. The boat control mechanism of claim 8, wherein the airwave signal is a radio wave.

15. The boat control mechanism of claim 8, wherein the wireless airwave transmitting means comprises at least:

a. a potentiometer having a tiller for indicating the selected direction; and b. a transmitter for generating a radio wave which corresponds to the selected steering direction.

* * * * *